US007555231B2

(12) United States Patent
Etter et al.

(10) Patent No.: US 7,555,231 B2
(45) Date of Patent: Jun. 30, 2009

(54) CAPACITIVE TONER LEVEL SENSOR AND METHODS OF USE

(75) Inventors: Paul Etter, Lexington, KY (US); Kerry Leland Embry, Midway, KY (US); Raymond Jay Barry, Lexington, KY (US); Richard G. Boyatt, III, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 74 days.

(21) Appl. No.: 11/531,803

(22) Filed: Sep. 14, 2006

(65) Prior Publication Data

US 2008/0069576 A1 Mar. 20, 2008

(51) Int. Cl.
*G03G 21/12* (2006.01)

(52) U.S. Cl. ..... 399/35; 324/662; 399/27; 399/360

(58) Field of Classification Search ..... 399/27, 399/24, 120, 123, 358, 360, 110, 111; 324/662, 324/663, 658, 71.1; 73/304 C
See application file for complete search history.

(56) References Cited

U.S. PATENT DOCUMENTS

| | | | | |
|---|---|---|---|---|
| 4,133,453 | A * | 1/1979 | Ohbora | 73/304 C X |
| 4,987,453 | A * | 1/1991 | Laukaitis | 399/49 |
| 5,465,619 | A * | 11/1995 | Sotack et al. | 73/304 C |
| 6,472,887 | B1 * | 10/2002 | Tullis et al. | 324/663 |
| 6,731,885 | B2 * | 5/2004 | Anthony et al. | 399/360 X |
| 6,775,487 | B2 * | 8/2004 | Kakeshita | 399/27 |
| 6,810,217 | B2 * | 10/2004 | Hiratsuka et al. | 399/27 |
| 2002/0012542 | A1 * | 1/2002 | Karakama et al. | 399/27 |
| 2002/0159780 | A1 * | 10/2002 | Chadani et al. | 399/27 |
| 2003/0123888 | A1 * | 7/2003 | Naito et al. | 399/27 |
| 2003/0235416 | A1 * | 12/2003 | Mochizuki et al. | 399/27 |

(Continued)

FOREIGN PATENT DOCUMENTS

JP 01-302284 A * 12/1989

(Continued)

OTHER PUBLICATIONS

Machine translation of JP 2003-345119 A dated Apr. 25, 2008.*

(Continued)

*Primary Examiner*—Sophia S Chen
(74) *Attorney, Agent, or Firm*—Coats and Bennett P.L.L.C.

(57) ABSTRACT

A capacitive sensor to detect toner volume levels in a toner container within an image forming device includes opposed electrodes disposed within the interior of the toner container. The opposed electrodes form a capacitor characterized by an inherent capacitance that varies in response to an amount of toner that exists between the opposed electrodes. A corresponding sensor circuit is electrically coupled to the opposed electrodes and adapted to sense an instantaneous capacitance of the capacitor to determine the amount of toner that exists between the opposed electrodes. The opposed electrodes may have different shapes and configurations, including for example, plates disposed within the toner container or the interior walls of the container itself. The sensor circuit is configured to apply an alternating current signal to the opposed electrodes and sense an output voltage that is indicative of an instantaneous capacitance of the capacitor corresponding to toner volume within the container.

29 Claims, 10 Drawing Sheets

U.S. PATENT DOCUMENTS

2005/0036810 A1* 2/2005 Murakami et al. ..... 399/360
2007/0065166 A1* 3/2007 Takiguchi et al. ..... 399/35

FOREIGN PATENT DOCUMENTS

JP 2003-345119 A * 12/2003

OTHER PUBLICATIONS

"Capacitive Sensors Offer Numerous Advantages," Electronic Design, Jan. 26, 1998, 9 pages, ED Online ID #7653, Penton Media, Inc, http://www.elecdesign.com/Articles/Print.cfm?ArticleID=7653.

Baxter, Larry K., "Capacitive Sensors" Jul. 20, 2000, 17 pages, http://www.capsense.com/capsense-wp.pdf.

* cited by examiner

CAPACITIVE TONER LEVEL SENSOR AND METHODS OF USE

BACKGROUND

The invention relates generally to an image forming device, and more particularly, to the sensing of toner levels in a toner container.

During the image forming process, toner is transferred from a toner supply container to toner carrying members and to print or copy media. Inefficiencies in the transfer process cause residual toner to remain on the toner carrying members or other transport members, such as transport belts, intermediate transfer belts/drums, and photoconductive members. Residual toner may also be created during registration, color calibration, paper jams, and over-print situations. This residual toner should be cleaned before it affects the quality of subsequent images. A blade or other cleaning device commonly removes the residual or waste toner and the removed toner is stored in a waste toner container.

Over time, toner levels in the toner supply container fall while levels in the waste toner container rise. Clearly, it is desirable to know the toner level in these containers. If the toner supply container nears an empty condition, print quality may suffer. Meanwhile, if a waste toner container overfills, the toner will spill into other regions of the image forming device, thus creating a mess and potentially causing print defects or other malfunctions. Estimates of toner use and accumulation based on print or time counts may not be accurate due to variability in factors such as environment, developer age, patch sensing cycles, transfer parameters, and the duration of operation without paper in the transfer path.

Accordingly, some type of level-sensing may be appropriate in the toner containers. Some known types of toner level sensors include electrical sensors that measure the motive force required to drive an agitator within the container, optical devices using mirrors and toner dust wipers in a container, and other opto-electro-mechanical devices such as a flag that moves with the toner level to actuate a sensor that triggers only when the volume reaches a predetermined level. Unfortunately, there are drawbacks to these known sensors that make these solutions less than ideal. For instance, toner agitation may create unwanted toner dust and the added complication of moving hardware. Furthermore, the addition of moving parts increases component complexity and opportunities for errors. Therefore, existing solutions may not provide an optimal means for detecting toner levels in a toner container within an image forming device.

SUMMARY

Embodiments disclosed herein are directed to a capacitive sensor to detect toner volume levels in a toner container within an image forming device. The capacitive sensor includes opposed electrodes disposed within the interior of the toner container. The opposed electrodes form a capacitor characterized by an inherent capacitance that varies in response to an amount of toner that exists between the opposed electrodes. Thus, capacitance levels may be obtained at various times to obtain an instantaneous toner volume level within the container. A corresponding sensor circuit is electrically coupled to the opposed electrodes and adapted to sense an instantaneous capacitance of the capacitor to determine the amount of toner that exists between the opposed electrodes. The opposed electrodes may have different shapes and configurations, including for example, plates disposed within the toner container or the interior walls of the container itself. Generally, the sensors may be oriented in a vertical configuration so that as toner levels change, the composite dielectric constant of the capacitor changes. The sensor circuit is configured to apply an alternating current signal to the opposed electrodes and sense an output voltage that is indicative of an instantaneous capacitance of the capacitor corresponding to toner volume within the container.

DETAILED DESCRIPTION

Figure 1:
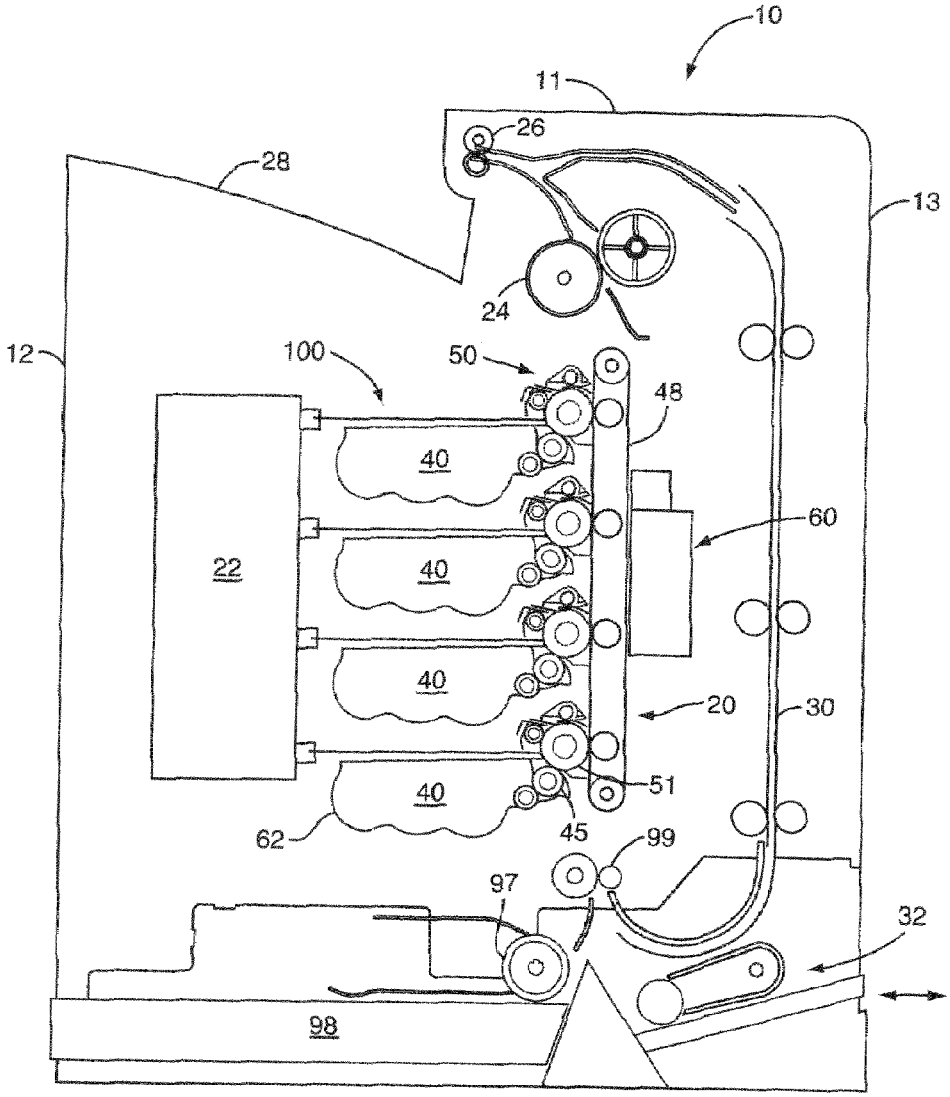
FIG. 1 is a functional block diagram of an image forming apparatus according to one embodiment.

The various embodiments disclosed herein are directed to a capacitive type sensor that may be used to sense relative toner levels within a toner container in an image forming device. FIG. 1 represents an exemplary image forming device in which the capacitive sensor may be implemented. The illustrated image forming device includes a main body 12, a media tray 98 with a pick mechanism 97 and a multi-purpose feeder 32, both of which are conduits for introducing media sheets into the device 10. The media tray 98 is preferably removable for refilling, and located on a lower section of the device 10. Media sheets are moved from the input and fed into a primary media path. One or more registration rollers 99 disposed along the media path aligns the print media and precisely controls its further movement along the media path. An endless belt 48 forms a section of the media path for moving the media sheets past a plurality of image forming units 100. Color printers typically include four image forming units 100 for printing with cyan, magenta, yellow, and black toner to produce a four-color image on the media sheet.

Each image forming unit 100 includes an associated photoconductive unit 50 and a developer unit 40. An optical scanning device 22 forms a latent image on a photoconductive member 51 in the photoconductive unit 50. The developer unit 40 supplies toner from a contained volume to the photoconductive unit 50 to develop the latent image. The developed image is subsequently transferred onto a media sheet that is moved past each of the photoconductive units 50 by a transport belt 48. The media sheet is then moved through a fuser 24 that adheres the toner to the media sheet. Exit rollers 26 rotate in a forward direction to move the media sheet to an output tray 28, or rollers 26 rotate in a reverse direction to move the media sheet to a duplex path 30. The duplex path 30 directs the inverted media sheet back through the image formation process for forming an image on a second side of the media sheet.

The exemplary image forming device 10 comprises a main body 12 and two door assemblies 11, 13. As used herein, the term "door assembly" is intended to refer to a door panel that is movably or detachably coupled to the main body 12. Exemplary door assemblies 11, 13 may simply comprise a door panel and any mounting hardware that permits relative movement between the main body 12, including but not limited to hinges and link arms or pivot arms. As indicated below, other components may be coupled to the door assemblies 11, 13. The first door assembly 11 is located towards a top side of the image forming device 10 while the second door assembly 13 is located towards a lateral side of the image forming device 10.

Figure 2:
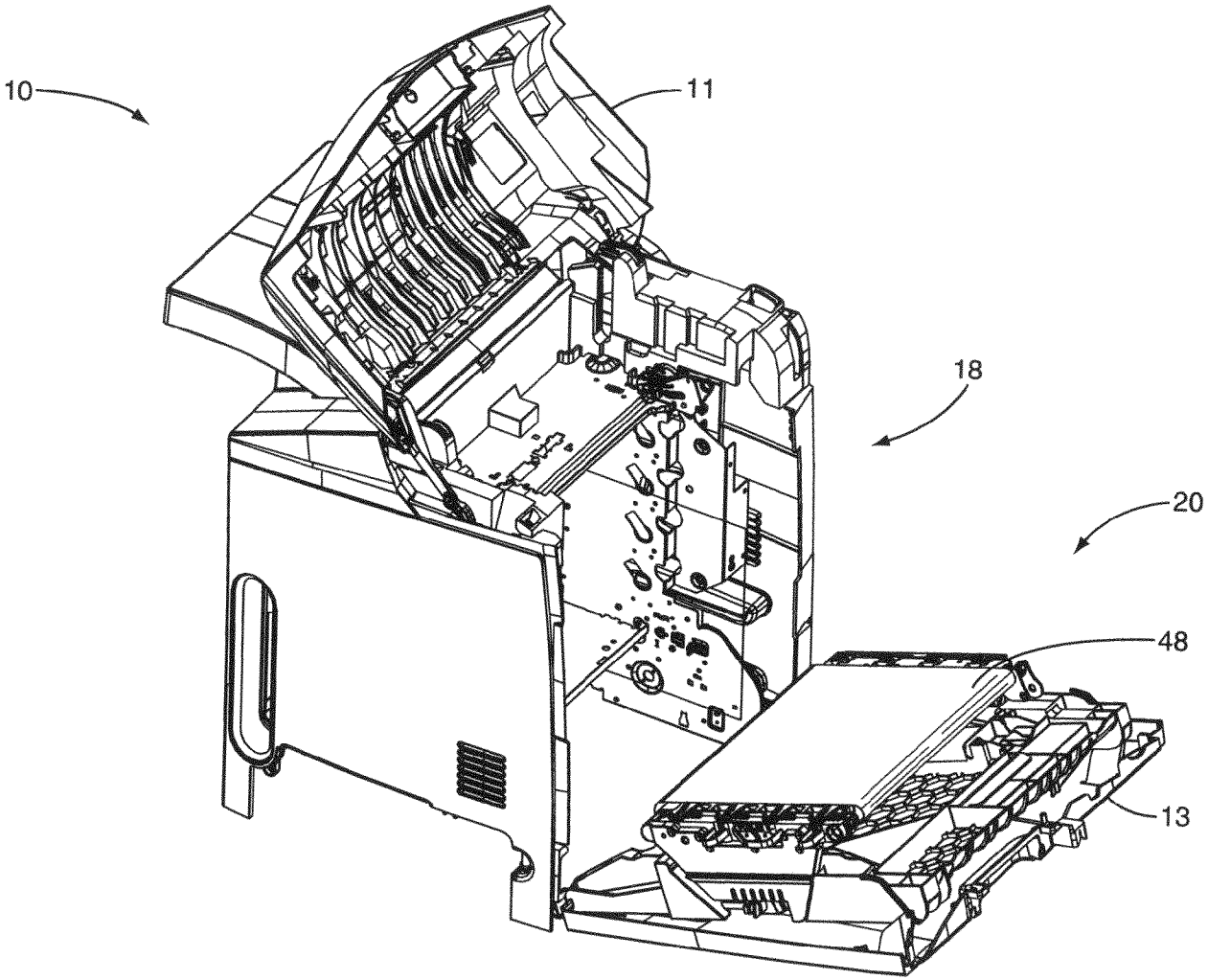
FIG. 2 is a schematic diagram of an image forming device having a plurality of moveable door assemblies according to one embodiment.
Figure 3:
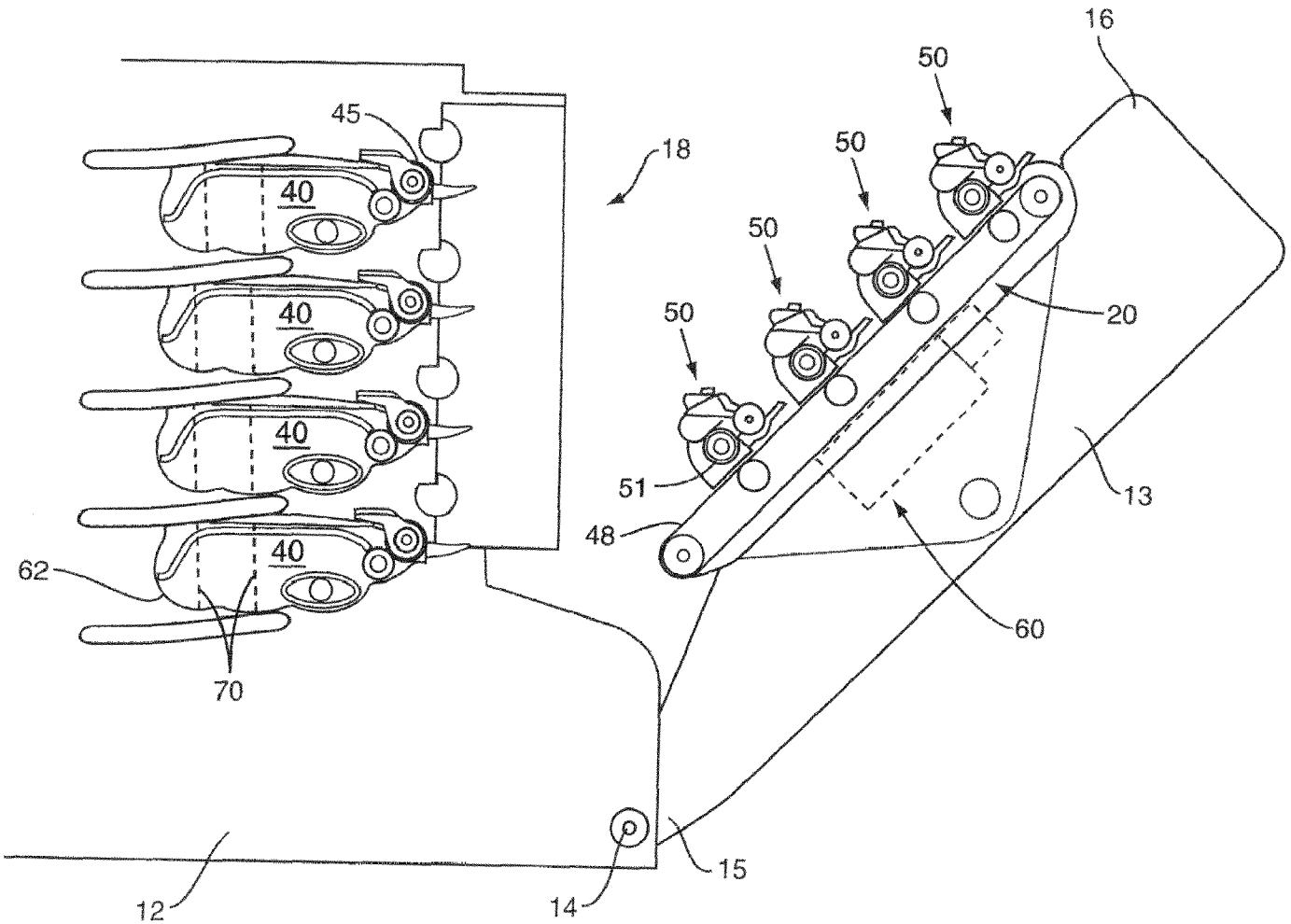
FIG. 3 is a is a cut-away side view an image forming device illustrating the relative location of toner containers according to one embodiment.

Each door assembly 11, 13 is movable between a closed position as represented in FIG. 1 and an open position as shown in FIGS. 2 and 3. In one embodiment the second door assembly 13 is pivotally attached to the main body 12 through a pivot 14. The pivot 14 may attach the main body 12 and second door assembly 13 at a variety of locations, such as towards a lower edge 15. In the open orientation, the door assembly upper edge 16 is spaced from the main body 12. One or more modules may be coupled to the first and second door assemblies 11, 13. For instance, FIG. 2 shows a belt module 20 coupled to the second door assembly 13. The belt module 20 may include an image transfer belt, a document transport belt, or other belt commonly used in image forming devices 10. The schematic illustrations provided in FIGS. 1 and 3 show one embodiment of an image forming device 10 where belt module 20 includes an endless belt 48 implemented as a transport belt. The belt module 20 further includes a pivoting structure (not explicitly identified) that allows the belt 48 to come into alignment with the image forming units 100. An example of an image forming device 10 incorporating this type of belt module 20 and door assembly 13 is provided in commonly assigned U.S. patent application Ser. No. 10/804,488, filed 19 Mar. 2004, now U.S. Pat. No. 7,162,182, the contents of which being incorporated by reference herein in its entirety.

Other modules may be coupled to the second door assembly as well. For example, some portion or the entire image forming unit 100 may be coupled to the second door assembly 13. FIG. 3 shows exemplary image forming units 100 that are constructed of a separate developer unit 40 and a photoconductor unit 50. The developer unit 40, including a developer member 45, may be positioned within an opening 18 in the main body 12 whereas the photoconductor unit 50 may be mounted to the second door assembly 13 along with the aforementioned belt module 20. In a closed orientation as illustrated in FIG. 1, the second door assembly 13 is positioned adjacent to the main body 12 with the photoconductive member 51 of the photoconductor unit 50 positioned adjacent the developer member 45 of the developer unit 40. In an open orientation as illustrated in FIG. 3, the second door assembly 13 is moved away from the main body 12 separating the photoconductor unit 50 and belt module 20 from the developer unit 40. This configuration provides direct and easy user access to the developer unit 40, photoconductor unit 50, and the belt module 20.

As indicated above, the developer member 45 supplies fresh toner to develop latent images that are formed on the photoconductive member 51. The fresh toner is stored within developer container 62. Over time, this fresh toner is consumed either as printed images or as waste toner. As images are developed and as the printer is used, some of the waste toner will move into one or more waste toner containers within the image forming device 10. In the embodiment shown, a waste toner container 60 is disposed adjacent the belt module 20. In one embodiment, the waste toner container 60 is forms a part of the belt module 20. The waste toner container 60 is configured to store accumulated waste toner that is removed from the endless belt 48. In one embodiment, the waste toner container 60 and endless belt 48 are replaceable as a single belt module 20 unit. In one embodiment, the waste toner container 60 is separable and replaceable independent of the endless belt 48. Other waste toner containers 60 may store accumulated waste toner that is removed from the photoconductive members 51.

A capacitive sensor 70 may be incorporated into either the fresh toner container 62 or waste toner container 60 to provide an indication of the relative toner levels contained therein. This capacitive sensor 70 may be implemented as a parallel plate sensor, though other types may be implemented. Accordingly, FIG. 3 shows a simplified, dashed-line representation of parallel plates to symbolize a capacitive sensor 70 located within each of the fresh toner containers 62. Further description of the details of exemplary capacitive sensors 70 are described herein in the context of the waste toner container 60. It should be understood that the teachings and concepts provided herein are applicable to a capacitive sensor 70 installed in other toner containers 60, 62.

Figure 5B:
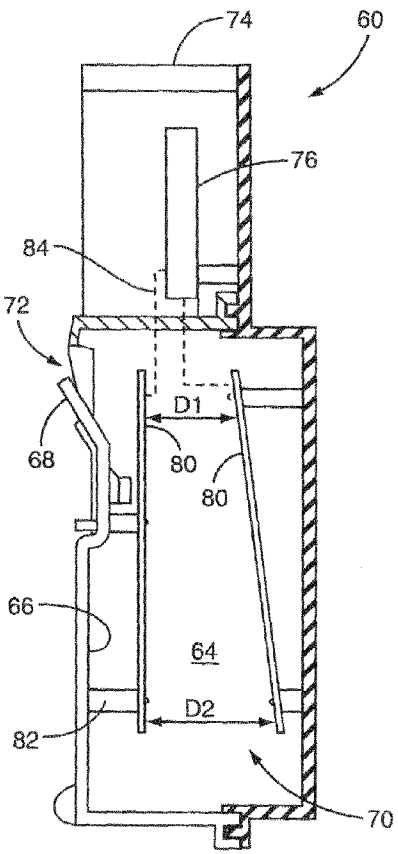
FIG. 5 is a side section view of a waste toner container including a capacitive waste toner sensor according to one embodiment.
Figure 5A:
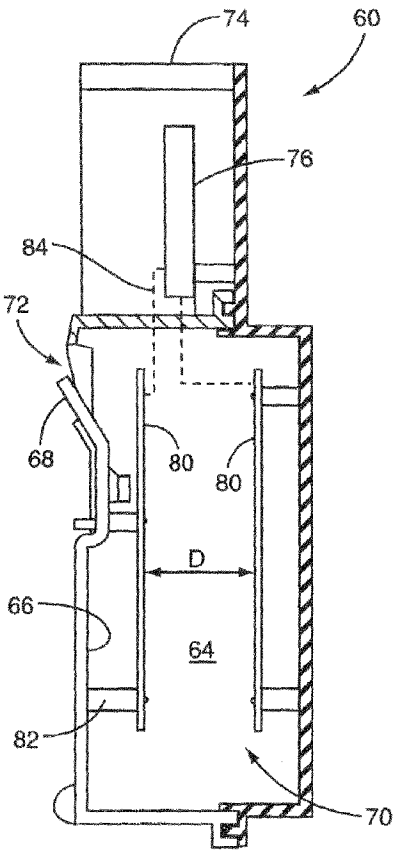
Figure 4:
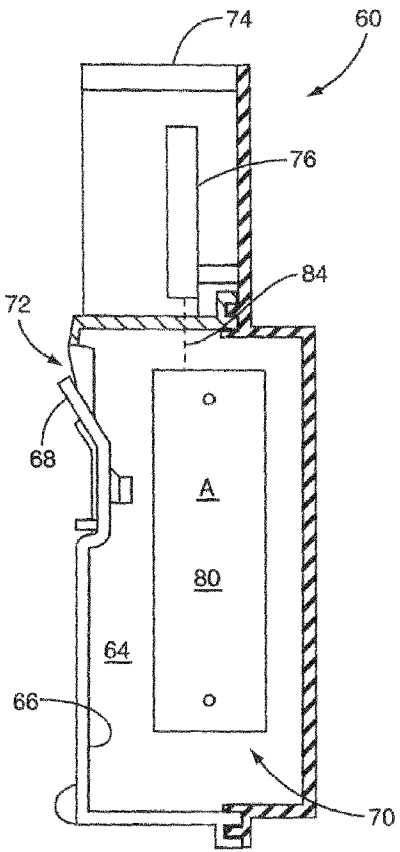
FIG. 4 is a side section view of a waste toner container including a capacitive waste toner sensor according to one embodiment.

FIGS. 4 and 5 illustrate a side cross section view of an exemplary waste toner container 60 including a capacitive toner sensor 70. The waste toner container 60 includes a storage volume 64 formed within the inner walls 66 of container 60. A cleaner blade 68 is disposed at the exterior of the storage volume 64 and abuts the endless belt 48 to remove waste toner from the surface of the belt 48 (see FIGS. 1, 3). Waste toner passes through a waste toner inlet 72 and collects within the storage volume 64.

In the embodiment shown, the waste toner container 60 includes sensor circuitry 76 in an adjoined sensor housing 74. The sensor circuitry 76 is described in greater detail below. The sensor circuitry 76 may include additional functionality, including for example patch sensing circuitry. However, in at least one embodiment, the sensor circuitry 76 includes circuitry to detect an instantaneous capacitance between electrodes 80 in the capacitive sensor 70.

In the embodiments shown in FIGS. 4 and 5, the capacitive sensor 70 is implemented as a parallel plate sensor including a pair of opposed, plate-type electrodes 80. In FIG. 4, the plate-type electrodes 80 are oriented parallel to each other, with the face of each electrode 80 facing substantially perpendicular to the process direction (which is perpendicular to the page). In FIG. 5, the plate-type electrodes 80 are oriented parallel to each other, with the face of each electrode 80 facing substantially parallel to the process direction. In each case, the electrodes 80 are oriented generally vertically so that as toner accumulates in the interior volume 64, the waste toner will fill the space between the electrodes 80. The plate-type electrodes 80 may be secured to side walls 66 via standoffs 82 or other mounting features. In one embodiment, the plate-type electrodes 80 are electrically insulated from the walls 66 of the waste toner container 60. However, the plate-type electrodes 80 are electrically coupled to the sensor circuitry 76 as indicated by the dashed-line connection 84 shown. Those skilled in the art will understand that there are a variety of techniques that can be used to electrically couple the electrodes 80 to the sensor circuitry 76. For example, in one embodiment, an electrical connection may be established from the electrodes 80 using conductive hardware (e.g., screw, bolt, rivet) to which a wire ring terminal (not specifically shown) is secured. In this manner, an insulated wire (also not shown) may be run between the conductive hardware and a connection terminal at the sensor circuitry 76. Other means of coupling the electrodes 80 to the sensor circuitry 76 may be used.

Figure 7:
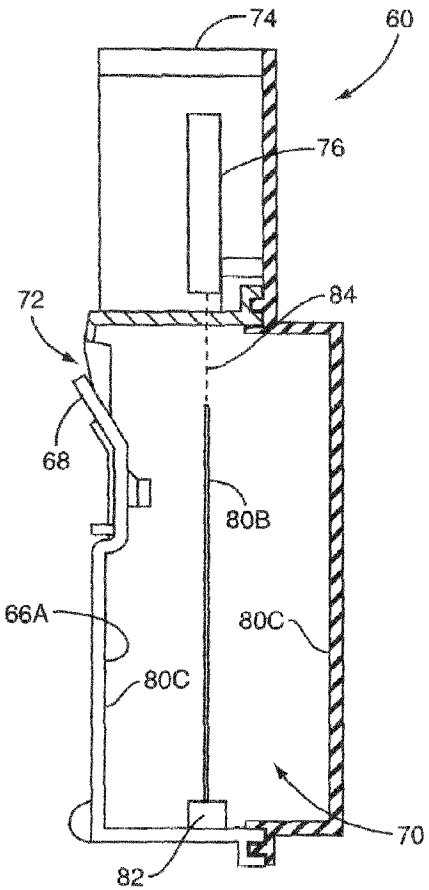
FIG. 7 is a side section view of a waste toner container including a capacitive waste toner sensor according to one embodiment.
Figure 6:
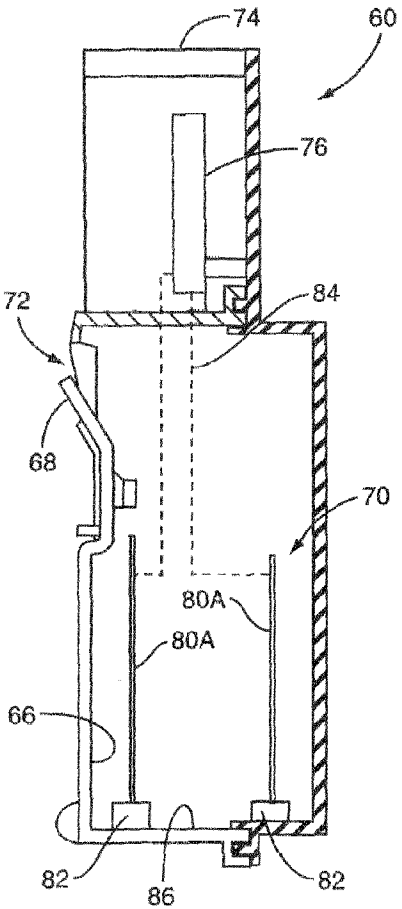
FIG. 6 is a side section view of a waste toner container including a capacitive waste toner sensor according to one embodiment.

Further, other types of electrodes 80 may be used. For example, FIGS. 6 and 7 illustrate embodiments in which the electrodes 80A, 80B, 80C have different forms. Specifically, FIG. 6 shows a pair of opposed rod-like electrodes 80A secured to a bottom surface 86 of the waste toner container 60. In FIG. 7, a rod- or plate-type electrode 80B is contained within the storage volume 64 and a metallic interior wall 66A forms an opposed electrode 80C. Other electrode shapes, including curved, cylindrical, coaxial, and other shapes as would occur to those skilled in the art may be implemented for the electrodes 80.

Regardless of the form of the electrodes 80, a capacitor is formed between the electrodes 80. As the level of toner within the storage volume 64 rises, the toner displaces the air or gas between the electrodes 80. Toner generally includes a different dielectric constant than air. Thus, a change in the value of the capacitor occurs due to a change in the composite dielectric constant of the substance between the electrodes 80. Generally, the capacitance relationship for an ideal capacitor is provided by:

$$C = 0.225 * K * \left(\frac{A}{D}\right) \tag{1}$$

where C=capacitance in picoFarads, K=dielectric constant of the material filling the space between the electrodes 80, A=area of overlap between the electrodes 80, and D=distance between the electrodes 80. The dielectric constant K is a numerical value that relates to the ability of the material between the electrodes 80 to store an electrostatic charge. According to equation (1), if a higher dielectric material replaces a lower one, the total capacitance increases. Furthermore, an increase in electrode area A and/or a decrease in separation distance D will each produce an increase in capacitance.

Notably, the electrodes 80 arrangement for the capacitive sensor 70 does not approach an ideal parallel plate capacitor because there are large fringe fields around the plate edges caused by a relatively large electrodes 80 separation. Therefore, equation (1) does not precisely represent the characteristics of the capacitive sensor 70. However, the present discussion is provided to describe the underlying relationship between dielectric constants and capacitance that allow the capacitive sensor 70 to work in the various embodiments disclosed herein.

The instantaneous capacitance for an ideal capacitive toner sensor 70 may be determined by:

$$C = 0.225 * K_{air} * \left(\frac{A_{air}}{D_{air}}\right) + 0.225 * K_{toner} * \left(\frac{A_{toner}}{D_{toner}}\right)$$

where $D_{air}$ and $D_{toner}$ are fixed and equal in the case of a parallel plate toner sensor 70. Note however, that the electrodes 80 may also be tilted relative to one another so that the distance D1 between the electrodes 80 is smaller towards the top of the electrodes 80 as compared to the distance D2 at the bottom of the sensors (as shown in FIG. 5B). This decreasing distance D may cause the capacitance to increase at a higher rate for a given amount of collected waste toner at the top of the electrodes 80 as compared to that at the bottom of the sensors. The variables $A_{air}$ and $A_{toner}$ relate to the relative amount of toner that fills the space between the electrodes 80. Initially, $A_{air}$ will be at a maximum and $A_{toner}$ will be zero. As toner fills the storage volume 64, $A_{toner}$ will increase and $A_{air}$ will decrease. The variable $K_{air}$ refers to the dielectric constant for air (about 1) and $K_{toner}$ refer to the dielectric constant for toner (about 1.5 in one embodiment). Different toner formulations may have dielectric constants other than 1.5 as used in the present example. Further, the dielectric constants $K_{air}$ and $K_{toner}$ may change slightly over time and over different environmental conditions. However, for ease of calculation, they may be considered constant, particularly when the change in the dielectric constants is small relative to the amount of change in the variables $A_{air}$ and $A_{toner}$. Thus, equation (2) may be reduced to:

$$C \approx A_{air} + 1.5 * A_{toner} \tag{3}$$

which shows that as the amount of toner in storage volume 64 increases, the higher the resultant measured capacitance. Therefore, by measuring the instantaneous capacitance of the capacitive sensor 70, one may determine the relative amounts of air and toner that fill the space between the electrodes 80. The approximations provided by equations (2) and (3) indicate the trend that capacitance decreases with increased electrodes 80 spacing and increases with increased electrodes 80 area. These equations further indicate the approximate linear relationship between dielectric constant and capacitance in this situation.

Figure 8:
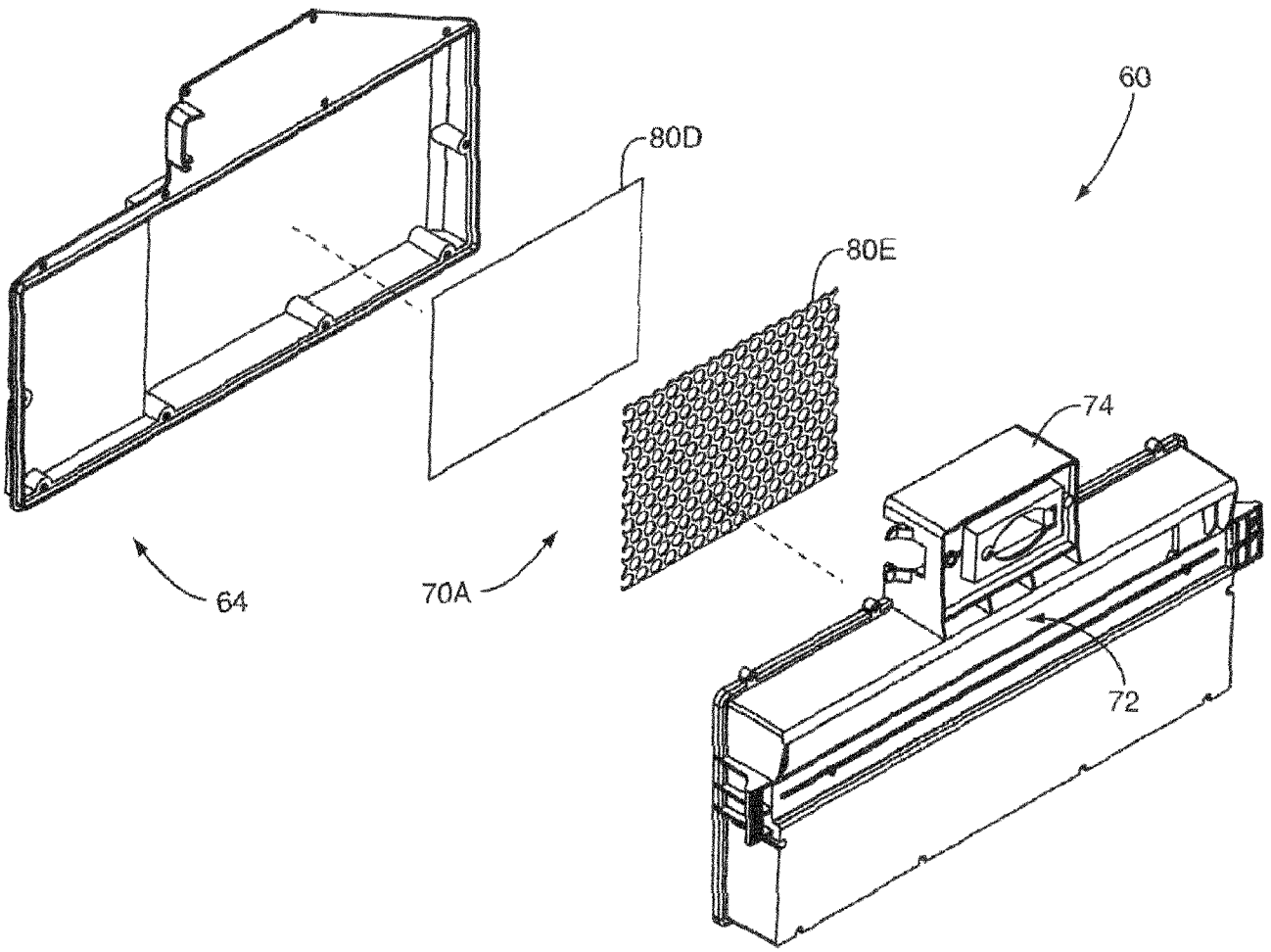
FIG. 8 is an exploded perspective view of a waste toner container including a capacitive waste toner sensor according to one embodiment.
Figure 9:
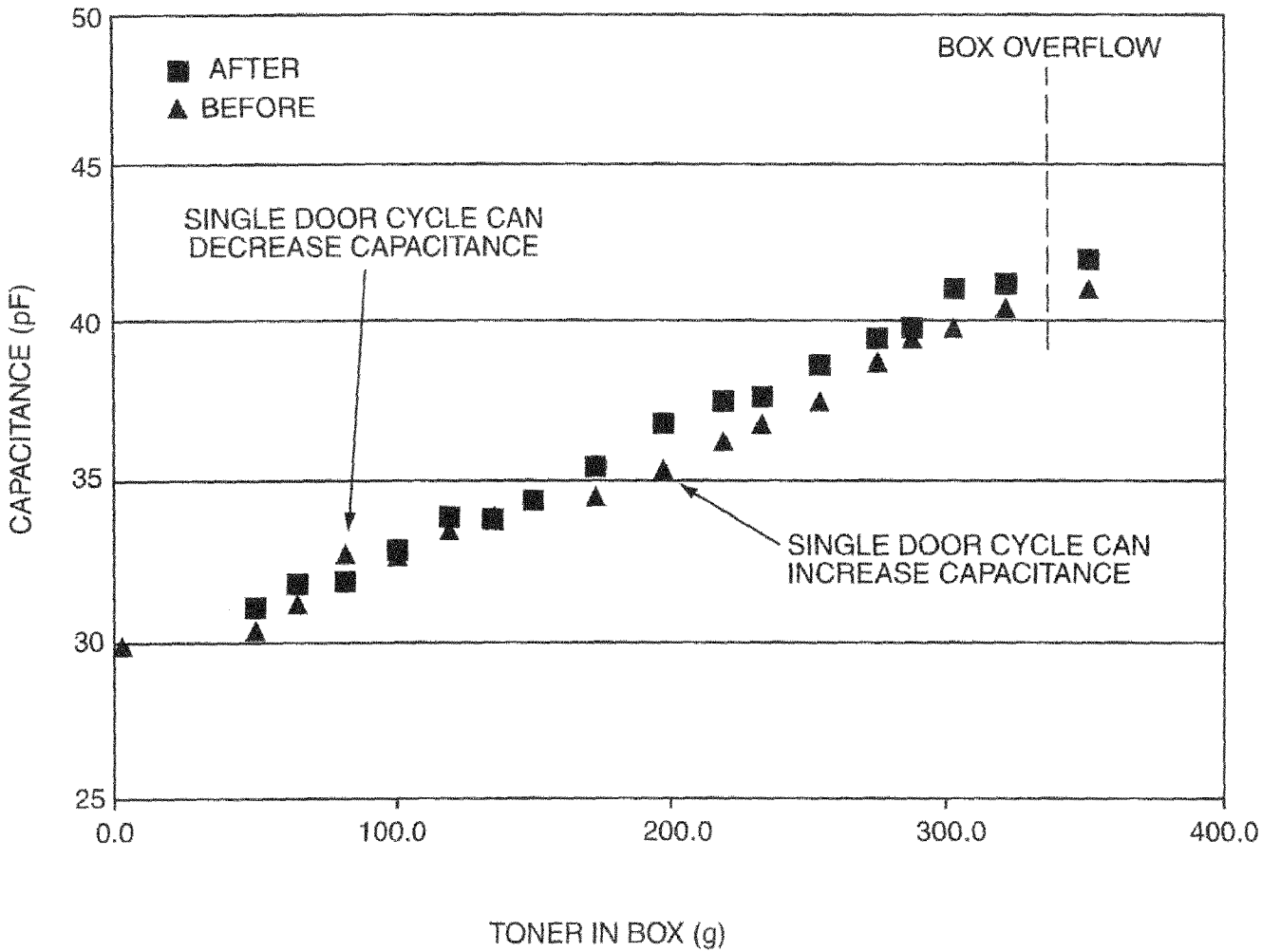
FIG. 9 is a graph illustrating a relationship between capacitance values for the capacitive sensor and toner volume according to one embodiment.
Figure 10:
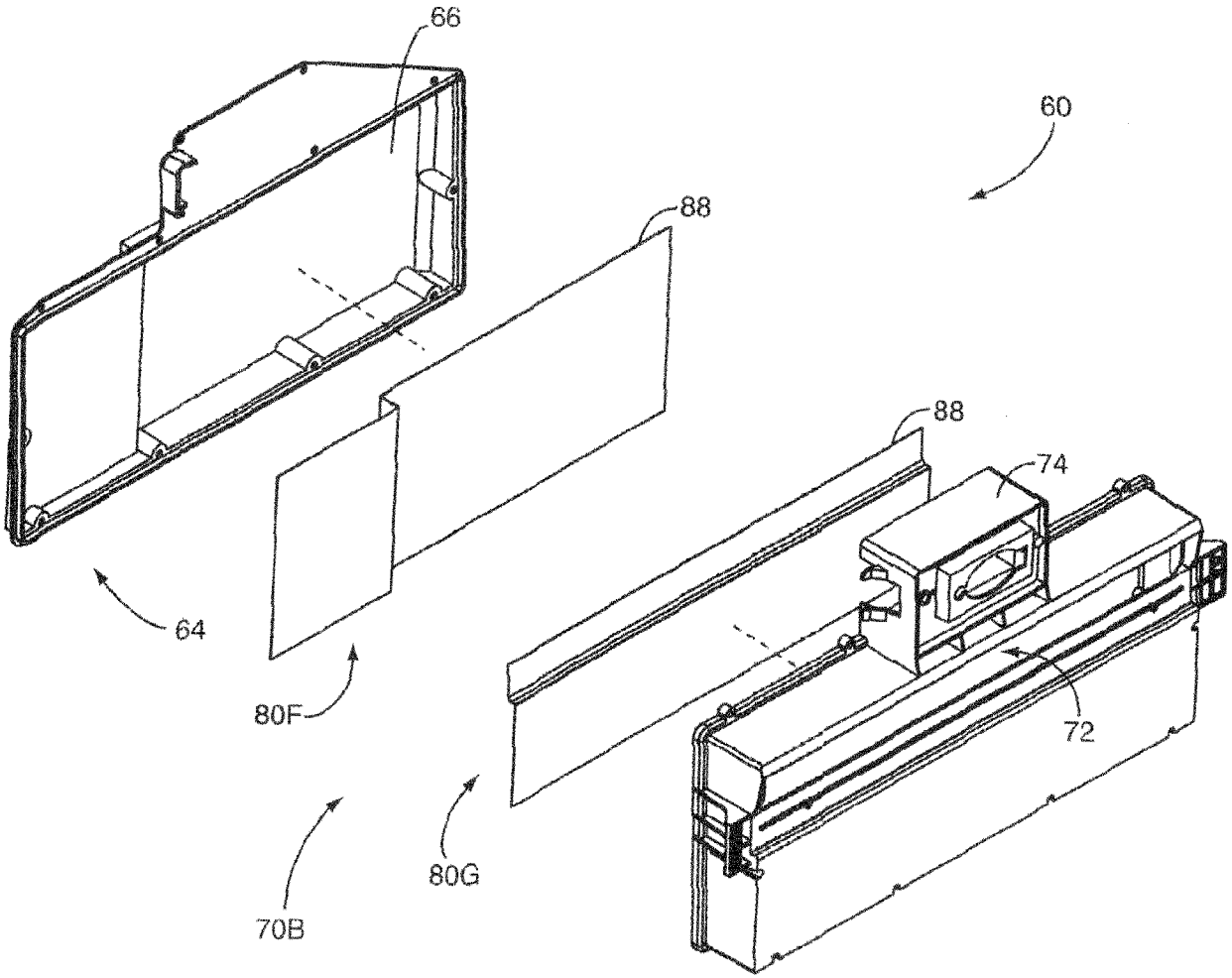
FIG. 10 is an exploded perspective view of a waste toner container including a capacitive waste toner sensor according to one embodiment.

Using these principals, a capacitive toner sensor 70 may be implemented within the exemplary waste toner container 60 using a variety of electrodes 80. The embodiments shown in FIGS. 8 and 10 depict two different embodiments. Other embodiments are certainly possible. In the embodiment shown in FIG. 8, the capacitive toner sensor 70A includes first and second plate electrodes 80D, 80E that are offset from each other. In one embodiment, the plate electrodes 80D, 80E include a surface area in the range between about 80 to 120 $cm^2$ and are spaced apart between about 2-4 mm, thereby providing a nominal capacitance of between about 30-35 pF for an empty waste container 60. As suggested above, the spacing between the electrodes 80D, 80E may vary from a larger value (e.g., about 4 mm) at the bottom to a smaller value (e.g., about 2 mm) at the top of the electrodes 80D, 80E. With exemplary electrodes 80D, 80E of this size and with a toner dielectric constant $K_{toner}$ of about 1.5, the nominal capacitance for a full waste toner container 60 may increase to a value between about 40-50 pF. Of course, these numbers are merely representative of one embodiment. The relative values and ranges may change depending on a particular configuration. FIG. 9 shows the relationship between the capacitance and waste toner volume for the exemplary capacitive sensor 70.

FIG. 9 shows two sets of data One set (identified by triangles) represents capacitance measurements taken before the front door assembly 13 is opened while the other set (identified by squares) represents capacitance measurements taken after the front door assembly 13 is closed. As indicated above, the waste toner container 60 is positioned adjacent an endless belt 48 that is mounted to a front door assembly 13. This door assembly 13 is opened and closed periodically by users who need to access the interior volume 18 of the image forming device 10. For instance, the door assembly 13 may be opened to replace developer units 40 or clear paper jams. The door 13 motion tends to disturb or jostle the waste toner container 60 and distribute the level of waste toner contained therein. This agitation tends to improve the reliability of the data set obtained after the front door assembly is closed. However, as the graph in FIG. 9 shows, the capacitance measurements may increase or decrease following a single open-close cycle of the front door assembly 13.

To further improve the distribution of waste toner within the waste toner container 60, one or both of the plate electrodes 80D, 80E may be perforated. In the embodiment shown in FIG. 8, the plate electrode 80E nearest the waste toner inlet 72 is perforated. The perforated plate electrode 80E still serves to create the desired capacitor while allowing waste toner to pass through and fill the interior volume 64. Otherwise, the space between the plate electrodes 80 may not fill evenly with waste toner, which may decrease the effectiveness of the sensor 70A.

In an embodiment of a capacitive sensor 70B illustrated in FIG. 10, the inner walls 66 of the waste toner container 60 are lined with electrically conductive material 88. Accordingly, the opposing vertical walls 66 on either side of the interior volume 64 form electrodes 80F, 80G of the exemplary capacitive sensor 70B. The conductive material 88 may include, for example, pliable metallic tape or sheet metal. Materials 88 having high electrical conductivity may be desirable. In one embodiment, the conductive material 88 is adhered to the inner walls 66. In one embodiment, the conductive material is secured to the inner walls 66 with securing hardware. In one embodiment, the conductive material 88 is molded into the inner walls 66.

In creating electrodes 80F, 80G at the walls 66 of the waste toner container 60, the interior volume 64 is maximized. This configuration eliminates concerns about toner packing and toner flow. Thus, the resulting capacitance is purely a function of the volume of waste toner collected between the two electrodes 80F, 80G. However, the electrodes 80F, 80G may be spaced farther apart than in the embodiment shown in FIG. 8. Because of the increased spacing between the electrodes 80F, 80G, the resulting capacitance and capacitance variation may decrease. For instance, with the embodiment shown, the capacitance of an empty box may be between about 6-8 pF. The capacitance when full of waste toner may be approximately 10-11 pF. The decreased range may make it more difficult to sense small changes in capacitance. However, if the sensor circuitry 76 includes an appropriate sensitivity and filtering capability, this type of capacitive sensor 70B may be appropriate.

Figure 11:
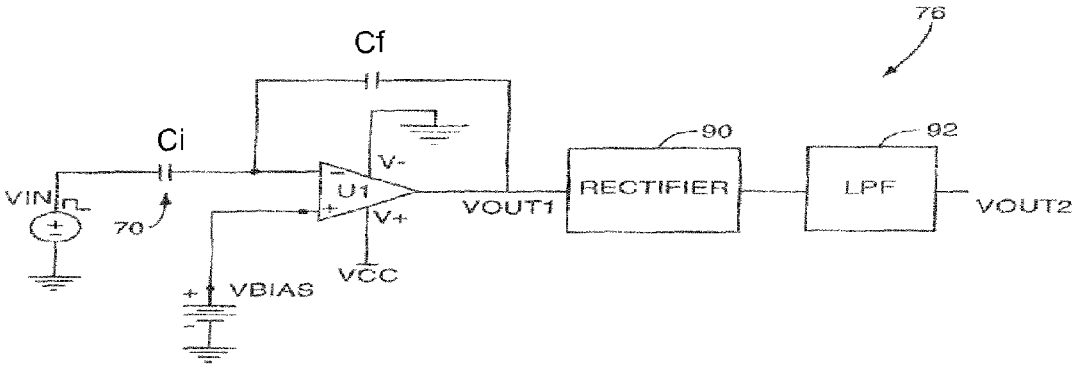
FIG. 11 is a schematic diagram of a sensor circuit to determine a capacitance of a capacitive sensor according to one embodiment.

To that end, the sensor circuitry 76 may be implemented using a number of techniques. One approach uses the principles of a feedback amplifier U1 as shown in FIG. 11 to determine the capacitance of the capacitive sensor 70, wherein VCC represented in FIG. 11 refers to power supply voltage. Once the capacitance is determined, the volume of waste toner in the waste toner container 60 may be determined using correlation data similar to that shown in FIG.9. As is well known to those skilled in the art, the input/output relationship of the feedback circuit in FIG.11 is described by the equation.

$$Vout1 = Vbias - \left(\frac{Ci}{Cf}\right) * Vin$$

where Cf is a known, fixed reference capacitance value and Ci represents the instantaneous capacitance of the capacitive sensor 70. The value of Cf may be set at any appropriate value, including at a value near the expected value of Ci. The output Vout1 of the feedback amplifier varies in relation to the comparative values of the capacitors Ci, Cf. The voltages Vin and Vbias are also predetermined values. Thus, equation (4) may be rewritten as follows $$Ci = \frac{Vbias - Vout1}{Vin} * Cf$$

to provide the instantaneous capacitance of the capacitive sensor 70 as a function of a measured amplifier U1 output voltage Vout1.

Capacitors are, by their very nature, energy storage devices that block DC current. Therefore, the input voltage Vin should include an AC component. In one embodiment, the input voltage Vin includes a square wave signal. Consequently, the feedback amplifier U1 produces an AC output with a DC offset that is generated by the voltage Vbias. In order to use equation (5), the AC portion in the output voltage Vout1 should be converted to a DC signal that is representative of the AC amplitude and the DC offset removed Accordingly, the output voltage Vout1 may be rectified and filtered with a conventionally known rectifier 90 and a conventionally known low pass filter (LPF) 92. A conventional first order RC filter may be used for the LPF 92, though it should be understood by those skilled in the art that other types of filters including Butterworth and higher order filters, may be used.

Figure 12:
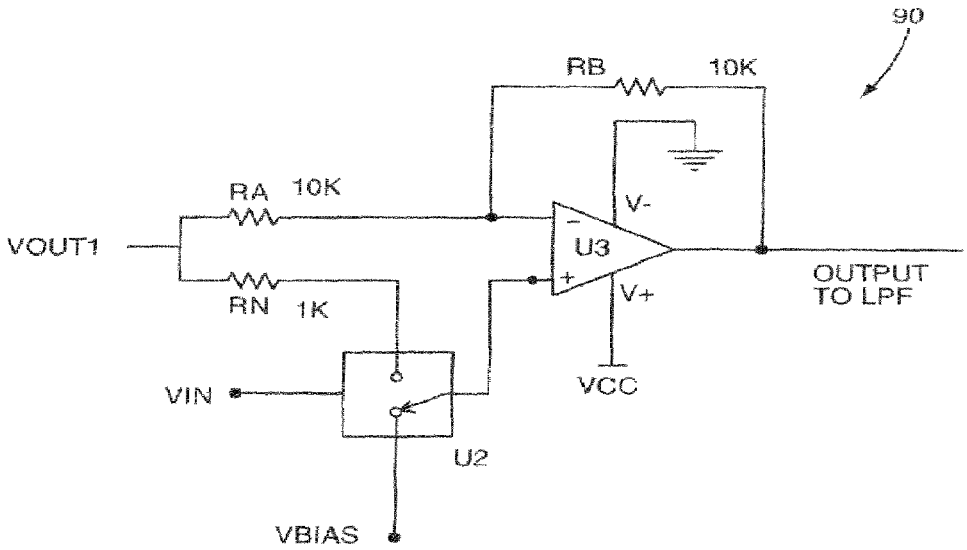
FIG. 12 is a schematic diagram of a synchronous rectifier used in a sensor circuit to determine a capacitance of a capacitive sensor according to one embodiment.

The rectifier 90 may be implemented using conventional diode rectifiers. However, in one embodiment, a synchronous rectifier 90 including resistors RA and RN for dividing VOUT1 and a resistor RB in series with the resistor RA as shown in FIG.12 is used. A synchronous rectifier 90 is generally known to have good noise rejections. In the illustrated embodiments the synchronous rectifier 90 is implemented using a unity gain amplifier U3 with reversible polarity. A switch U2 (e.g., a multiplexer or other switching device) is toggled synchronously with the input voltage Vin to provide the polarity reversal every half cycle of the input voltage Vin. With this implementation, equation (4) may be modified as follows:

$$Vout2 = \left(\frac{Ci}{Cf}\right) * \text{AVERAGE}(|Vin|) + Vbias$$

which again may be rewritten as follows $$Ci = \frac{Vout2 - Vbias}{\text{AVERAGE}(|Vin|)} * Cf$$

to provide the instantaneous capacitance of the capacitive sensor 70 as a function of a measured LPF 92 output voltage Vout2.

Figure 13:
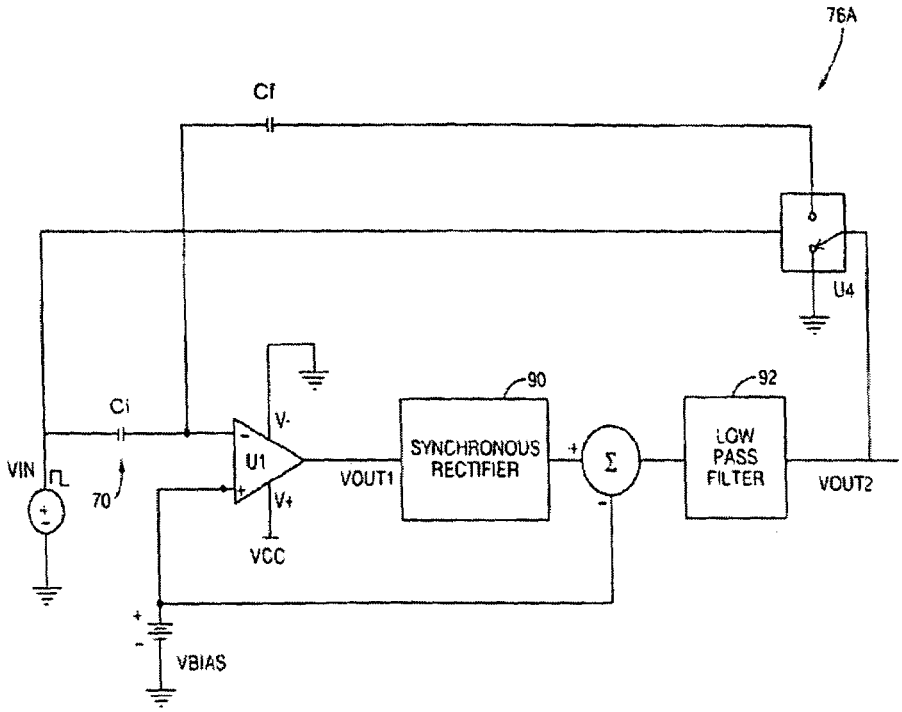
FIG. 13 is a schematic diagram of a sensor circuit to determine a capacitance of a capacitive sensor according to one embodiment.

In an embodiment shown in FIG. 13, additional improvements may be achieved by closing the feedback loop around the entire sensor circuit 76A rather than around the first stage amplifier U1 as shown in FIG. 11. To achieve this modified feedback loop, an additional switch U4 is added to the output Vout2 of the LPF 92. This switch U4 modifies the DC output into an AC signal that is 180 degrees out of phase with the input signal Vin. The sensor circuit 76A further includes a summer to remove the bias voltage Vbias before the low pass filter 92. Thus, the bias voltage Vbias need not be subtracted from the output voltage Vout2 in calculating the instantaneous capacitance Ci of the capacitive sensor 70. Closing the feedback loop in this way tends to reduce sensitivity to distortion in the rectifier stage and allows the use a low cost op-amp U1. Furthermore, one may design most of the gain into the low pass filter stage where the signal has only low frequency content to relieve the first stage (which generally handles high frequencies) of requiring high gain or large amplitude signals. Consequently, this circuit advantageously rejects noise at frequencies other than that of the input signal Vin. This noise filtering is an important characteristic since capacitance sensors tend to pick up ambient noise. In this particular application, the capacitor plates may be relatively large and may tend to pick up an extraordinary amount of ambient noise.

The present invention may be carried out in other specific ways than those herein set forth without departing from the scope and essential characteristics of the invention. For example, the sensor circuitry described herein may be implemented using discrete components. However, those skilled in the art will recognize that microcontroller-based sensors may be incorporated into programmable devices, including for example microprocessors, DSPs, ASICs, or other stored-program processors. The present embodiments are, therefore to be considered in all respects as illustrative and not restrictive and all changes coming within the meaning and equivalency range of the appended claims are intended to be embraced therein.

What is claimed is:

1. A capacitive sensor to detect toner volume levels in a toner container within an image forming device, said capacitive sensor comprising:

opposed electrodes disposed within the interior of the toner container, the opposed electrodes forming a capacitor including an inherent capacitance that varies in response to an amount of toner existing between the opposed electrodes; and sensor circuitry electrically coupled to the opposed electrodes and adapted to sense an instantaneous capacitance of the capacitor to determine the amount of toner that exists between the opposed electrodes.

2. The capacitive sensor of claim 1 wherein the opposed electrodes comprise a pair of opposed plates.

3. The capacitive sensor of claim 2 wherein the opposed plates are substantially parallel to each other.

4. The capacitive sensor of claim 2 wherein the opposed plates are tilted with respect to each other.

5. The capacitive sensor of claim 1 wherein at least one of the opposed electrodes is a plate.

6. The capacitive sensor of claim 5 wherein the plate is perforated.

7. The capacitive sensor of claim 1 wherein at least one of the opposed electrodes is formed by an interior wall of the toner container.

8. The capacitive sensor of claim 1 wherein the toner container is a waste toner container.

9. The capacitive sensor of claim 8 wherein the waste toner container is coupled to a door assembly on the image forming device.

10. A capacitive sensor to detect toner volume levels in a toner container within an image forming device, said capacitive sensor comprising:

opposed conductive plates oriented generally vertically within the interior of the toner container, the plates forming a capacitor including an inherent capacitance that varies according to an amount of toner existing between the plates; and sensor circuitry electrically coupled to the plates and adapted to sense an instantaneous capacitance of the capacitor to determine the amount of toner that exists between the plates.

11. The capacitive sensor of claim 10 wherein the opposed plates are substantially parallel to each other.

12. The capacitive sensor of claim 10 wherein the opposed plates are tilted with respect to each other.

13. The capacitive sensor of claim 10 wherein at least one of the opposed plates is perforated.

14. The capacitive sensor of claim 10 wherein at least one of the opposed plates is formed by an interior wall of the toner container.

15. The capacitive sensor of claim 10 wherein the opposed plates are formed by opposing interior walls of the toner container.

16. The capacitive sensor of claim 10 wherein at least one of the opposed plates is secured to an interior wall of the toner container.

17. The capacitive sensor of claim 10 wherein the toner container is a waste toner container.

18. The capacitive sensor of claim 17 wherein the waste toner container is coupled to a door assembly on the image forming device.

19. A method of sensing an instantaneous volume of toner that exists within a toner container in an image forming device comprising the steps of:

electrically coupling sensor circuitry to opposed electrodes disposed within the interior of the toner container the opposed electrodes forming a capacitor including an inherent capacitance that varies in response to an amount of toner existing between the opposed electrodes;

applying an alternating current signal to the opposed electrodes; and sensing a first voltage indicative of a first capacitance corresponding to an empty waste toner container;

sensing a second voltage indicative of a second capacitance corresponding to a full waste toner container; and sensing a third voltage indicative of a third capacitance corresponding to an intermediate toner level within the waste toner container.

20. The method of claim 19 wherein the sensor circuitry and the capacitor are coupled within a feedback loop.

21. The method of claim 19 wherein the sensor circuitry further comprises a feedback amplifier, a voltage output of the feedback amplifier indicating the capacitance of the capacitor.

22. The method of claim 21 further comprising rectifying and filtering the voltage output of the feedback amplifier.

23. The method of claim 22 wherein the step of rectifying the voltage output of the feedback amplifier comprises synchronously rectifying the voltage output with a unity gain amplifier.

24. A method of sensing an instantaneous volume of toner that exists within a toner container in an image forming device comprising the steps of:

electrically coupling sensor circuitry to opposed electrodes disposed within the interior of the toner container, the opposed electrodes forming a capacitor including an inherent capacitance that varies in response to an amount of toner existing between the opposed electrodes;

applying an alternating current signal to the opposed electrodes; and sensing an instantaneous capacitance of the capacitor to determine the amount of toner that exists between the opposed electrodes.

25. The method of claim 24 wherein the sensor circuitry and the capacitor are coupled within a feedback loop.

26. The method of claim 24 wherein the sensor circuitry further comprises a feedback amplifier, a voltage output of the feedback amplifier indicative of the instantaneous capacitance of the capacitor.

27. The method of claim 26 further comprising rectifying and filtering the voltage output of the feedback amplifier.

28. The method of claim 27 wherein the step of rectifying the voltage output of the feedback amplifier comprises synchronously rectifying the voltage output with a unity gain amplifier.

29. A method of sensing an instantaneous volume of toner that exists within a toner container in an image forming device comprising the steps of:

electrically coupling sensor circuitry to opposed electrodes disposed within the interior of the toner container the opposed electrodes forming a capacitor including an inherent capacitance that varies in response to an amount of toner existing between the opposed electrodes and sensor circuitry having a feedback amplifier, a voltage output of the feedback amplifier indicating the capacitance of the capacitor;

applying an alternating current signal to the opposed electrodes;

sensing a first voltage indicative of a first capacitance corresponding to an empty waste toner container;

sensing a second voltage indicative of a second capacitance corresponding to a full waste toner container;

sensing a third voltage indicative of a third capacitance corresponding to an intermediate toner level within the waste toner container; and rectifying and filtering the voltage output of the feedback amplifier, wherein the step of rectifying the voltage output of the feedback amplifier comprises synchronously rectifying the voltage output with a unity gain amplifier.

* * * * *